US005929012A

United States Patent [19]

Del Duca et al.

[11] Patent Number: 5,929,012

[45] **Date of Patent: *Jul. 27, 1999**

[54] LAUNDRY PRETREATMENT WITH PEROXIDE BLEACHES CONTAINING CHELATORS FOR IRON, COPPER OR MANGANESE FOR REDUCED FABRIC DAMAGE

[75] Inventors: Valerio Del Duca, Massa Lubrense, Italy; John Scott Park, Tyne & Wear, United Kingdom; Dario Rapisarda, Rome, Italy; Barry Stoddart, Tyne & Wear, United Kingdom; Marina Trani, Rome, Italy; Taher Iqbal Yousaf, Egham, United Kingdom

[73] Assignee: Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/894,830

[22] PCT Filed: Feb. 20, 1996

[86] PCT No.: PCT/US96/02219

§ 371 Date: Jan. 23, 1998

§ 102(e) Date: Jan. 23, 1998

[87] PCT Pub. No.: WO96/26999

PCT Pub. Date: Sep. 6, 1996

[30] Foreign Application Priority Data

Feb. 28, 1995 [EP] European Pat. Off. ..... 95870018

[51] Int. Cl.[6] ..... C11D 3/395; C11D 7/122; C11D 1/29; C11D 3/24

[52] U.S. Cl. ..... 510/303; 510/283; 510/284; 510/292; 510/309; 499/502; 499/533; 499/506; 499/352; 8/137

[58] Field of Search ..... 510/283, 284, 510/296, 303, 309, 499, 502, 533, 352, 506; 8/137

[56] References Cited

U.S. PATENT DOCUMENTS

| | | | |
|---|---|---|---|
| 3,655,569 | 4/1972 | Hellsten et al. | 256/99 |
| 3,676,338 | 7/1972 | Fries et al. | 252/8.75 |
| 3,686,126 | 8/1972 | Smeets | 252/99 |
| 3,844,951 | 10/1974 | Fries et al. | 252/8.6 |
| 4,595,527 | 6/1986 | Gipp | 252/546 |
| 4,690,771 | 9/1987 | Ouhadi et al. | 252/102 |
| 4,704,233 | 11/1987 | Hartman et al. | 252/527 |
| 4,749,516 | 6/1988 | Brusky | 252/546 |
| 4,753,750 | 6/1988 | Ouhadi et al. | 252/139 |
| 4,756,849 | 7/1988 | Weber et al. | 252/542 |
| 4,889,652 | 12/1989 | Sullivan et al. | 252/99 |
| 4,900,468 | 2/1990 | Mitchell et al. | 252/95 |
| 5,118,436 | 6/1992 | Aoyagi et al. | 252/97 |
| 5,186,856 | 2/1993 | Holland | 252/143 |
| 5,221,496 | 6/1993 | Holland | 252/143 |
| 5,523,013 | 6/1996 | Durbut et al. | 252/12.1 |
| 5,648,326 | 7/1997 | Sramek | 510/284 |
| 5,652,208 | 7/1997 | Sramek | 510/284 |

FOREIGN PATENT DOCUMENTS

| | | |
|---|---|---|
| 0209228 | 1/1987 | European Pat. Off. . |
| 0 629 691 A 1 | 12/1994 | European Pat. Off. . |
| 0629690 | 12/1994 | European Pat. Off. . |

*Primary Examiner*—Kery Fries
*Attorney, Agent, or Firm*—C. Brant Cook; Kim W. Zerby; Jacobus C. Rasser

[57] ABSTRACT

A process for pretreating soiled fabrics prior to washing with a liquid composition comprising a peroxygen bleach, a nonionic surfactant, an anionic surfactant and a compound chelating copper and/or iron and/or manganese is provided. The liquid composition used in such process is also provided.

21 Claims, No Drawings

LAUNDRY PRETREATMENT WITH PEROXIDE BLEACHES CONTAINING CHELATORS FOR IRON, COPPER OR MANGANESE FOR REDUCED FABRIC DAMAGE

TECHNICAL FIELD

The present invention relates to the pretreatment of soiled fabrics, to compositions suitable to be used as pretreater, and to a pretreatment process.

BACKGROUND

Peroxygen bleach-containing compositions have been extensively described in laundry applications as laundry detergents, laundry additives or even laundry pretreaters.

Indeed, it is known to use such peroxygen bleach-containing compositions in laundry pretreatment applications to boost the removal of encrusted stains/soils which are otherwise particularly difficult to remove such as grease, coffee, tea, grass, mud/clay-containing soils and the like. However, we have found that a drawback associated with such peroxygen bleach-containing compositions is that said compositions may damage fabrics when used in pretreatment application, i.e. when applied directly onto the fabrics, and left to act onto said fabrics for prolonged periods of time before washing said fabrics.

It is thus an object of the present invention to provide improved fabrics safety when pretreating fabrics with peroxygen bleach-containing compositions, especially in those applications where said compositions are left into contact with said fabrics during prolonged periods of time, before washing said fabrics.

When pretreating fabrics with compositions comprising a peroxygen bleach like hydrogen peroxide, it has been found that the presence of metal ions such as copper and/or iron and/or manganese on the surface of fabrics produces fabric damage resulting in loss of tensile strength of the fabric fibres. It is speculated that the presence of metal ions such as copper and/or iron and/or manganese on the surface of the fabrics, especially on cellulosic fibres, catalyses the radical decomposition of peroxygen bleaches like hydrogen peroxide. Thus, a radical reaction occurs on the surface of the fabric with generation of free radicals, which results in tensile strength loss.

Therefore we have found that it is essential that this surface radical reaction be controlled in the pretreatment environment, thereby providing improved safety to fabrics.

It has now been found that this can be achieved by formulating a peroxygen bleach-containing composition which comprises a compound for chelating copper and/or iron and/or manganese. More particularly, it has been found that the use of a compound for chelating copper and/or iron and/or manganese, and preferably diethylene triamine penta methylene phosphonic acid (DTPMP), hydroxy-ethane diphosphonic acid (HEDP), ethylenediamine N,N'-disuccinic acid (EDDS), methyl glycine di-acetic acid (MGDA), diethylene triamine penta acetic acid (DTPA), propylene diamine tetracetic acid (PDTA), 2-hydroxypyridine-N-oxide (HPNO), or ethylenedinitrilotertrakis (methylenephosphonic acid) N,N,-dioxide, in a peroxygen bleach-containitng composition, considerably reduces the damage on a fabric pretreated with such a composition.

An advantage associated to the use of a peroxygen bleach-containing composition comprising such a compound for chelating copper and/or iron and/or manganese, in laundry pretreatment application, is that color damage is also reduced.

A further advantage of the present invention is that excellent laundry performance on bleachable stains is provided as well as on removing greasy stains.

Another advantage of the present invention is that the compositions suitable to be used according to the present invention also provide excellent performance when used in other applications, apart from laundry pretreater application, such as in other laundry applications, as a laundry detergent or laundry additive, or even in hard surface cleaning applications.

In one embodiment of the present invention it has also been found that the use of a chelating agent like ethylenedinitrilotertrakis (methylenephosphonic acid) N,N,-dioxide, hydroxy-ethane diphosphonic acid (HEDP) and/or a chelating agent having two electron-donor groups able to occupy adjacent co-ordination sites in the metal ions sphere of co-ordination so as to form complexes with metal ions in which each metal ion is complexed by 3 molecules of chelating agents like 2-hydroxypyridine-N-oxide, allows to formulate acidic liquid compositions suitable for pretreating fabrics which exhibit improved chemical stability upon prolonged storage time.

Peroxygen bleach-containing compositions have been extensively described in the art. EP-A- 629691 discloses emulsions of nonionic surfactants comprising a silicone compound, and as optional ingredients, hydrogen peroxide, or a water soluble source thereof, and chelants. The only chelant disclosed is S,S,-ethylene diamino disuccinic acid (see examples). Although pretreatment application is disclosed for the compositions of EP-A 629691, the use of peroxygen bleach-containing compositions comprising a compound chelating copper and/or iron and/or manganese, for pretreating fabrics, whereby the loss of tensile strength in said fabrics is reduced, is nowhere disclosed.

EP-A- 629690 discloses emulsions of nonionic surfactants comprising a terephthalate-based polymer, and as optional ingredients, hydrogen peroxide, or a water soluble source thereof, and chelants. The only chelant disclosed is S,S,-ethylene diamino disuccinic acid (see examples). Although pretreatment application is disclosed for the compositions of EP-A 629690, the use of peroxygen bleach-containing compositions comprising a compound chelating copper and/or iron and/or manganese, for pretreating fabrics, whereby the loss of tensile strength in said fabrics is reduced, is nowhere disclosed.

EP-B-209 228 discloses compositions comprising a peroxide source like hydrogen peroxide, an amino polyphosphonate chelant and a radical scavenger. Diethylene triamine penta methylene phosphonic acid is expressly disclosed. Also EP-B-209 228 discloses that the hydrogen peroxide-containing compositions may be used as pre-spotters. However, nowhere it is mentioned that peroxygen bleach-containing compositions comprising a compound chelating copper and/or iron and/or manganese, for pretreating fabrics, allow to reduce the loss of tensile strength in said fabrics.

SUMMARY OF THE INVENTION

The present invention encompasses the use of a liquid composition comprising a peroxygen bleach and a compound chelating copper and/or iron and/or manganese, for pretreating a soiled fabric before said fabric is washed, whereby the loss of tensile strength in said fabric is reduced.

The present invention further encompasses a process of pretreating soiled fabrics with a liquid composition comprising a peroxygen bleach and a compound chelating copper and/or iron and/or manganese, and said process comprises the steps of applying said composition in its neat form onto the fabric and allowing said composition to remain in contact with said fabric without leaving said composition to dry onto said fabric, before said fabric is washed.

The present invention further encompasses a liquid detergent composition comprising a peroxygen bleach and, as a compound chelating copper and/or iron and/or manganese, methyl glycine di-acetic acid, propylene diamine tetracetic acid, 2-hydroxypyridine-N-oxide, ethylenedinitrilotertrakis (methylenephosphonic acid) N,N,-dioxide, hydroxy-ethane diphosphonic acid, or mixtures thereof.

DETAILED DESCRIPTION OF THE INVENTION

In its broadest aspect, the present invention encompasses the use of a liquid composition comprising a peroxygen bleach and a compound chelating copper and/or iron and/or manganese, for pretreating a soiled fabric before said fabric is washed, whereby the loss of tensile strength in said fabric is reduced.

The present invention is based on the finding that, fabric damage resulting in tensile strength loss is reduced, when compositions comprising a peroxygen bleach and a compound chelating copper and/or iron and/or manganese according to the present invention are used to pretreat soiled fabrics, as compared to the use of the same compositions but without any compound chelating copper and/or iron and/or manganese, to pretreat said fabrics.

By "to pretreat soiled fabrics" it is to be understood that the liquid composition is applied in its neat form onto the soiled fabric and left to act onto said fabric before said fabric is washed, as described herein after, in the process of pretreating soiled fabrics according to the present invention.

In other words, the use of a peroxygen bleach-containing composition comprising a compound chelating copper and/or iron and/or manganese according to the present invention allows to considerably reduce the tensile strength loss caused by the presence of copper and/or iron and/or manganese on the fabric surface, even if said composition is left onto the fabric to be pretreated upon a prolonged period of time before washing said fabric, e.g. about 24 hours, and even if said fabric is contaminated by high levels of copper and/or iron and/or manganese.

The tensile strength loss of a fabric may be measured by employing the Tensile Strength method, as can be seen in the examples herein after. This method consists in measuring the tensile strength of a given fabric by stretching said fabric until it breaks. The force, expressed in Kg, necessary to break the fabric is the "Ultimate Tensile Stress" and may be measured with "The Stress-Strain INSTRON Machine". By "tensile strength loss" it is to be understood the difference when comparing the tensile strength of a fabric taken as a reference, i.e. a fabric which has not been pretreated, and the tensile strength of the same fabric after having been pretreated according to the present invention. A tensile strength loss of zero means that no fabric damage is observed.

An a dvantage associated to the present invention is that the color damage is also reduced. Indeed, the color change or/and decoloration observed when pretreating soiled colored fabrics with a peroxygen bleach-containing composition comprising a compound chelating copper and/or iron and/or manganese according to the present invention, is reduced, as compared to the color change and/or decoloration observed when using the same composition but without any such compound for chelating copper and/or iron and/or manganese, this even if said composition is left onto the fabrics upon prolonged periods of time before washing said fabrics. Accordingly, the present invention also encompasses the use of a liquid composition comprising a peroxygen bleach and a compound chelating copper and/or iron and/or manganese for pretreating a soiled colored fabric before said fabric is washed, whereby the color damage of said fabric is reduced.

Also fabric tensile strength loss reduction and/or fabric color damage reduction are obtained with liquid compositions comprising a peroxygen bleach and a compound chelating copper and/or iron and/or manganese without compromising on the bleaching performance nor on the stain removal performance delivered by said compositions.

The present invention further encompasses a process of pretreating soiled fabrics with a liquid composition comprising a peroxygen bleach and a compound chelating copper and/or iron and/or manganese, said process comprises the steps of applying said composition in its neat form onto the fabric and allowing said composition to remain in contact with said fabric without leaving said composition to dry onto said fabric, before said fabric is washed. Said composition may remain in contact with said fabric, typically for a period of 1 minute to 24 hours, preferably 1 minute to 1 hour and more preferably 5 minutes to 30 minutes. Optionally, when the fabric is soiled with encrusted stains/soils which otherwise would be relatively difficult to remove, the compositions according to the present invention may be rubbed and/or brushed more or less intensively, for example, by means of a sponge or a brush or simply by rubbing two pieces of fabric each against the other. By "washing" it is to be understood herein to simply rinse the fabrics with water, or the fabrics may be washed with conventional compositions comprising at least one surface active agent, this by means of a washing machine or simply by hand.

By "in its neat form" it is to be understood that the compositions described herein are applied onto the fabrics to be pretreated without undergoing any dilution, i.e. they are applied as described herein.

According to the process of pretreating soiled fabrics of the present invention, the liquid compositions used in said process should not be left to dry onto the fabrics. Indeed, it has been found that water evaporation contributes to increase the concentration of free radicals onto the surface of the fabrics and, consequently, the rate of chain reaction. It is also speculated that an auto-oxidation reaction occurs upon evaporation of water when the liquid compositions are left to dry onto the fabrics. Said reaction of auto-oxidation generates peroxy-radicals which may contribute to the degradation of cellulose. Thus, not leaving the liquid compositions, as described herein, to dry onto the fabric, in the process of pretreating soiled fabrics according to the present invention, contributes to the benefits according to the present invention, i.e. to reduce the tensile strength loss when pretreating fabrics with liquid peroxygen bleach-containing compositions.

As an essential element the compositions suitable to be used according to the present invention comprise a peroxygen bleach. Preferred peroxygen bleach is hydrogen peroxide, or a water soluble source thereof, or mixtures thereof. Hydrogen peroxide is most preferred to be used in the compositions according to the present invention. As used herein a hydrogen peroxide source refers to any compound which produces hydrogen peroxide when said compound is in contact with water.

Suitable water-soluble sources of hydrogen peroxide for use herein include percarbonates, persilicate, persulphate such as monopersulfate, perborates and peroxyacids such as diperoxydodecandioic acid (DPDA), magnesium perphthalatic acid and mixtures thereof.

Typically, the compositions suitable to be used herein comprise from 0.5% to 20% by weight of the total composition of said peroxygen bleach, preferably from 2% to 15% and most preferably from 3% to 10%. Indeed, the presence of peroxygen bleach, preferably hydrogen peroxide provides strong cleaning benefits which are particularly noticeable in laundry applications.

As a second essential ingredient, the compositions suitable to be used according to the present invention comprise a compound chelating copper and/or iron and/or manganese. Typically, the compositions suitable to be used herein comprise from 0.005% to 2% by weight of the total composition of said compound chelating copper and/or iron and/or manganese, or mixtures thereof, preferably from 0.01% to 1% and most preferably from 0.01% to 0.5%.

Said compounds chelating copper and/or iron and/or manganese may be any compound capable of binding copper and/or iron and/or manganese. Such compounds chelating copper and/or iron and/or manganese can be selected from the group comprising phosphonate chelants, amino carboxylate chelants, polyfunctionally-substituted aromatic chelating agents or polycarboxylic acids of pyridine and the like, or mixtures thereof.

Such phosphonate chelants may include ethydronic acid, hydroxy-ethane diphosphonic acid (HEDP) and ethylenedinitrilotertrakis (methylenephosphonic acid) N,N-oxide as well as amino phosphonate compounds such as amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Phosphonate chelants are commercially available from Monsanto under the trade name DEQUEST®. Preferred phosphonate chelants to be used herein are diethylene triamine penta methylene phosphonates, hydroxy-ethane diphosphonic acid (HEDP) and ethylenedinitrilotertrakis (methylenephosphonic acid) N,N-oxide.

Hydroxy-ethane diphosphonic acid and ethylenedinitrilotertrakis (methylenephosphonic acid) N,N-oxide have been found to be particularly resistant to protonation and oxidation. Thus hydroxy-ethane diphosphonic acid and ethylenedinitrilotertrakis (methylenephosphonic acid) N,N-oxide are particularly suitable for application in acidic liquid compositions as a compound for chelating copper and/or iron and/or manganese according to the present invention whereby fabrics safety is improved. Indeed, hydroxyethane diphosphonic acid and/or ethylenedinitrilotertrakis (methylenephosphonic acid) N,N-oxide allow to formulate liquid acidic peroxygen bleach-containing compositions with improved chemical stability as compared to the same compositions without said chelating agent, or as compared to the same compositions but with another chelating agent, e.g. diethylene triamine penta methylene phosphonic acid, instead of said chelating agent. Thus another aspect of the present invention is the use of hydroxy-ethane diphosphonic acid and/or ethylenedinitrilotertrakis (methylenephosphonic acid) N,N-oxide, in an acidic liquid peroxygen bleach-containing composition, whereby the chemical stability of said composition is improved, i.e. the rate of decomposition of said bleach is reduced upon prolonged time of storage of said composition.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disuifobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987. to Hartman and Perkins. Ethylenediamine N,N'-disuccinic acids is, for instance, commercially available under the tradename ssEDDS® from Palmer Research Laboratories.

Such amino carboxylates useful as compounds chelating copper and/or iron and/or manganese include ethylene diamine tetra acetates, diethylene triamine pentaacetates, diethylene triamine pentoacetate (DTPA), N-hydroxyethylethylenediamine triacetates, nitrilotriacetates, ethylenediamine tetraproprionates, triethylenetetraaminehexa-acetates, ethanoldiglycines, propylene diamine tetracetic acid (PDTA) and methyl glycine di-acetic acid (MGDA), both in their acid form, or in their alkali metal, ammonium, and substituted ammonium salt forms. Particularly suitable to be used herein are diethylene triamine penta acetic acid (DTPA), propylene diamine tetracetic acid (PDTA) which is, for instance, commercially available from BASF under the trade name Trilon FS® and methyl glycine di-acetic acid (MGDA).

Suitable polycarboxylic acids of pyridine to be used herein include dipicolinic acid. Preferred herein dipicolinic acid is used in mixture with another compound for chelating copper and/or iron and/or manganese according to the present invention. Indeed, dipicolinic acid is preferably added on top of other chelants herein in a liquid composition according to the present invention to improve the chemical stability of said composition.

Other chelating agents suitable to be used herein as compounds chelating copper and/or iron and/or manganese include chelating agents having two electron-donor groups able to occupy adjacent co-ordination sites in the metal ions sphere of co-ordination so as to form complexes with metal ions in which each metal ion is complexed by 3 molecules of chelating agents (3:1 chelating agent:metal ion stoichiometrie). In other words, said chelating agents occupy the co-ordination sphere of the metal ion, making it thereby catalytically inactive. Said chelating agents have been found to be particularly resistant to protonation and/or oxidation. Said chelating agents are thus particularly suitable for application in acidic liquid compositions as a compound for chelating copper and/or iron and/or manganese according to the present invention whereby fabrics safety is improved. Indeed, said chelating agents having two electron-donor groups able to occupy adjacent co-ordination sites in the metal ions sphere of co-ordination allow to formulate acidic peroxygen bleach-containing compositions with improved chemical stability as compared to the same compositions without any such chelating agents or as compared to the same compositions with another chelating agent, e.g. diethylene triamine penta methylene phosphonic acid, instead of said chelating agents. Thus, another aspect of the present invention is the use of chelating agents having two electron-donor groups able to occupy adjacent co-ordination sites in the metal ions sphere of coordination so as to form complexes with metal ions in which each metal ion is complexed by 3 molecules of said chelating agents, in an acidic liquid peroxygen bleach-containing composition, whereby the chemical stability of said composition is improved, i.e. the rate of decomposition of said bleach is reduced upon prolonged time of storage of said composition.

Said chelating agents having two electron-donor groups able to occupy adjacent co-ordination sites in the metal ions sphere of co-ordination include chelating agents having at least an ionised carboxylate directly adjacent to one of the following groups: an unionised carboxylate, a hydroxyl group, an amino group or an N-oxide group. Particularly suitable to be used herein are malonic acid, 2-hydroxypyridine-N-oxide, or mixtures thereof.

2-hydroxy-pyridine-N-oxide is, for instance, commercially available from Pyrion Chemie (Germany) under the trade name 2-hydroxy-pyridine-N-oxide.

According to the present invention, liquid compositions comprising a peroxygen bleach and, as a compound chelating copper and/or iron and/or manganese, propylene diamine tetracetic acid (PDTA), methyl glycine di-acetic acid (MGDA), diethylene triamine penta methylene phosphonate (DTPMP), hydroxy-ethane diphosphonic acid (HEDP), ethylenediamine N,N'-disuccinic acid (EDDS), 2-hydroxypyridine-N-oxide (HPNO), and/or ethylenedinitrilotertrakis (methylenephosphonic acid) N,N-oxide, provide virtually no tensile strength loss in fabrics pretreated therewith, i.e. the fabric resistance is not reduced, even upon prolonged contact periods of said compositions onto said fabrics, e.g. 24 hours.

The present invention accordingly further encompasses liquid compositions comprising a peroxygen bleach, as described herein before and, as the compound chelating copper and/or iron and/or manganese, propylene diamine tetracetic acid (PDTA), methyl glycine di-acetic acid (MGDA), 2-hydroxypyridine-N-oxide, ethylenedinitrilotertrakis (methylenephosphonic acid) N,N-oxide, hydroxyethane diphosphonic acid, or mixtures thereof. The following description of the compositions relates to the compositions of the present invention claimed per se, to the compositions used according to the present invention for pretreating soiled fabrics and to the compositions applied onto the fabrics according to the process of pretreating soiled fabrics of the present invention.

The compositions according to the present invention are aqueous liquid cleaning compositions. Said aqueous compositions have a pH as is of from 1 to 9, preferably from 2 to 6 and more preferably from 3 to 5. The pH of the compositions can be adjusted by using organic or inorganic acids, or alkalinising agents.

The compositions according to the present invention may further comprise a variety of optional ingredients such as radical scavengers, surfactants, builders, stabilisers, other chelants, soil suspenders, dye transfer agents, solvents, brighteners, perfumes, antioxidants, foam suppressors and dyes.

A preferred optional ingredient of the compositions according to the present invention is a radical scavenger or mixtures thereof. Suitable radical scavengers for use herein include the well-known substituted mono and di hydroxy benzenes and their analogs, alkyl and aryl carboxylates and mixtures thereof. Preferred radical scavengers for use herein include butyl hydroxy toluene, hydroquinone, di-tert-butyl hydroquinone, mono-tert-butyl hydroquinone, tert-butyl-hydroxy anysole, benzoic acid, touic acid, Catechol, t-butyl catechol, benzylamine, 1,1,3-tris(2-methyl-4-hydroxy-5-t-butylphenyl) butane, commercially available under the trade name Topanol CA® ex ICI, as well as n-propyl-gallate. Radical scavengers when used, are typically present herein in amounts ranging from 0.001% to 2% by weight of the total composition and preferably from 0.001% to 0.5% by weight.

The compositions according to the present invention may further comprise any surfactant known to those skilled in the art including nonionic, anionic, cationic, zwitterionic, or amphoteric surfactants. The compositions according to the present invention preferably comprise any of the nonionic surfactants or mixtures thereof described herein after and/or any of the anionic surfactants or mixtures thereof described herein after. Typically, the compositions according to the present invention may comprise up to 50% by weight of the total composition of a surfactant, or mixtures thereof.

The compositions of the present invention may also comprise a liquid hydrophobic bleach activator, as a highly preferred optional ingredient. By bleach activator, it is meant herein a compound which reacts with hydrogen peroxide to form a peracid. The peracid thus formed constitutes the activated bleach. By "hydrophobic bleach activator", it is meant herein an activator which is not substantially and stably miscible with water. Typically, such hydrophobic bleach activators have an HLB of below 11. Such suitable liquid hydrophobic bleach activators typically belong to the class of esters, amides, imides, or anhydrides. A particular family of bleach activators of interest was disclosed in EP 624 154, and particularly preferred in that family is acetyl triethyl citrate (ATC). ATC has the other advantages that it is environmentally friendly in that it eventually degrades into citric acid and alcohol. Also, ATC has good hydrolytical stability in the compositions herein, and it is an efficient bleach activator. Finally, it provides good building capacity to the compositions. It is also possible to use mixtures of liquid hydrophobic bleach activators herein. The compositions herein may comprise up to 20% by weight of the total composition of said bleach activator or mixtures thereof, preferably from 2% to 10%, most preferably from 3% to 7%.

When the peroxygen bleach-containing compositions according to the present invention further comprise a liquid hydrophobic bleach activator it is highly desired herein for stability purpose to formulate said compositions either as aqueous emulsions of surfactants which comprise said liquid hydrophobic bleach activator, or as microemulsions of said liquid hydrophobic bleach activator in a matrix comprising water, the peroxygen bleach and a hydrophilic surfactant system comprising an anionic and a nonionic surfactant.

In the embodiment of the present invention where the peroxygen bleach-containing compositions of the present invention further comprise said bleach activator and are formulated as aqueous emulsions, said peroxygen bleach-containing emulsions comprise an emulsifying surfactant system of at least two different surfactants, i.e. at least a hydrophobic surfactant having an HLB up to 9 and at least a hydrophilic surfactant having an HLB above 10 in order to emulsify the liquid hydrophobic bleach activator. Indeed, said two different surfactants in order to form emulsions which are stable must have different HLB values (hydrophilic lipophilic balance), and preferably the difference in value of the HLBs of said two surfactants is at least 1, preferably at least 3. In other words, by appropriately combining at least two of said surfactants with different HLBs in water, stable emulsions will be formed, i.e. emulsions which do not substantially separate into distinct layers, upon standing for at least two weeks at 50° C.

The emulsions according to the present invention comprise from 2% to 50% by weight of the total composition of said hydrophilic and hydrophobic surfactants, preferably from 5% to 40% and more preferably from 8% to 30%. The emulsions according to the present invention comprise at least from 0.1% by weight of the total emulsion of said hydrophobic surfactant, or mixtures thereof, preferably at least 3% and more preferably at least 5% and at least from 0.1% by weight of the total emulsion of said hydrophilic surfactant, or mixtures thereof, preferably at least 3%, and more preferably at least 6%.

Preferred to be used herein are the hydrophobic nonionic surfactants and hydrophilic nonionic surfactants. Said hydrophobic nonionic surfactants to be used herein have an HLB up to 9, preferably below 9, more preferably below 8 and said hydrophilic surfactants have an HLB above 10, preferably above 11, more preferably above 12. Indeed, the hydrophobic nonionic surfactants to be used herein have excellent grease cutting properties, i.e. they have a solvent effect which contributes to hydrophobic soils removal. The hydrophobic surfactants act as carrier of the hydrophobic brighteners onto the fabrics allowing thereby said brighteners to work in close proximity with the fabrics surface since the beginning of the wash.

Suitable nonionic surfactants for use herein include alkoxylated fatty alcohols preferably, fatty alcohol ethoxylates and/or propoxylates. Indeed, a great variety of such alkoxylated fatty alcohols are commercially available which have very different HLB values (hydrophilic lipophilic balance). The HLB values of such alkoxylated nonionic surfactants depend essentially on the chain length of the fatty alcohol, the nature of the alkoxylation and the degree of alkoxylation. Hydrophilic nonionic surfactants tend to have a high degree of alkoxylation and a short chain fatty alcohol, while hydrophobic surfactants tend to have a low degree of alkoxylation and a long chain fatty alcohol. Surfactants catalogs are available which list a number of surfactants including nonionics, together with their respective HLB values.

Suitable chemical processes for preparing the nonionic surfactants for use herein include condensation of corresponding alcohols with alkylene oxide, in the desired proportions. Such processes are well known to the man skilled in the art and have been extensively described in the art. As an alternative, a great variety of alkoxylated alcohols suitable for use herein is commercially available from various suppliers.

Preferred hydrophobic nonionic surfactants to be used according to the present invention are surfactants having an HLB up to 9 and being according to the formula RO—$(C_2H_4O)_n(C_3H_6O)_mH$, wherein R is a $C_6$ to $C_{22}$ alkyl chain or a $C_6$ to $C_{28}$ alkyl benzene chain, and wherein n+m is from 0.5 to 5 and n is from 0 to 5 and m is from 0 to 5 and preferably n+m is from 0.5 to 4 and, n and m are from 0 to 4. The preferred R chains for use herein are the $C_8$ to $C_{22}$ alkyl chains. Accordingly suitable hydrophobic nonionic surfactants for use herein are Dobanol $^R$ 91-2.5 (HLB=8.1; R is a mixture of $C_9$ and $C_{11}$ alkyl chains, n is 2.5 and m is 0), or Lutensol $^R$ TO3 (HLB=8; R is a mixture of $C_{13}$ and $C_{15}$ alkyl chains, n is 3 and m is 0), or Tergitol $^R$ 25L3 (HLB=7.7; R is in the range of $C_{12}$ to $C_{15}$ alkyl chain length, n is 3 and m is 0), or Dobanol $^R$ 23-3 (HLB=8.1; R is a mixture of $C_{12}$ and $C_{13}$ alkyl chains, n is 3 and m is 0), or Dobanol $^R$ 23-2 (HLB=6.2; R is a mixture of $C_{12}$ and $C_{13}$ alkyl chains, n is 2 and m is 0), or mixtures thereof. Preferred herein are Dobanol $^R$ 23-3, or Dobanol $^R$ 23-2, Lutensol $^R$ TO3, or mixtures thereof. These Dobanol $^R$ surfactants are commercially available from SHELL. These Lutensol $^R$ surfactants are commercially available from BASF and these Tergitol $^R$ surfactants are commercially available from UNION CARBIDE. Other suitable hydrophobic nonionic surfactants to be used herein are non alkoxylated surfactants. An example is Dobanol $^R$ 23 (HLB<3).

Preferred hydrophilic nonionic surfactants to be used according to the present invention are surfactants having an HLB above 10 and being according to the formula RO—$(C_2H_4O)_n(C_3H_6O)_mH$, wherein R is a $C_6$ to $C_{22}$ alkyl chain or a $C_6$ to $C_{28}$ alkyl benzene chain, and wherein n+m is from 5 to 11 and n is from 0 to 11 and m is from 0 to 11, preferably n+m is from 6 to 10 and, n and m are from 0 to 10. Throughout this description n and m refer to the average degree of the ethoxylation/propoxylation. The preferred R chains for use herein are the $C_8$ to $C_{22}$ alkyl chains. Accordingly suitable hydrophilic nonionic surfactants for use herein are Dobanol $^R$ 23-6.5 (HLB=11.9; R is a mixture of $C_{12}$ and $C_{13}$ alkyl chains, n is 6.5 and m is 0), or Dobanol $^R$ 25-7 (HLB=12; R is a mixture of $C_{12}$ to $C_{15}$ alkyl chains, n is 7 and m is 0), or Dobanol $^R$ 45-7 (HLB=11.6; R is a mixture of $C_{14}$ and $C_{15}$ alkyl chains, n is 7 and m is 0), or Dobanol $^R$ 91-5 (HLB=11.6; R is a mixture of $C_9$ to $C_{11}$ alkyl chains, n is 5 and m is 0), or Dobanol $^R$ 91-6 (HLB=12.5; R is a mixture of $C_9$ to $C_{11}$ alkyl chains, n is 6 and m is 0), or Dobanol $^R$ 91-8 (HLB=13.7; R is a mixture of $C_9$ to $C_{11}$ alkyl chains, n is 8 and m is 0), or Dobanol $^R$ 91-10 (HLB=14.2; R is a mixture of $C_9$ to $C_{11}$ alkyl chains, n is 10 and m is 0), or mixtures thereof. Preferred herein are Dobanol $^R$ 91-10, or Dobanol $^R$ 45-7, Dobanol $^R$ 23-6.5, or mixtures thereof. These Dobanol $^R$ surfactants are commercially available from SHELL. Apart from the hydrophilic nonionic surfactants other hydrophilic surfactants may further be used in the emulsions of the present invention such as anionic surfactants described herein after.

The emulsions according to the present invention may further comprise other surfactants which should however not significantly alter the weighted average HLB value of the overall emulsion.

In a particularly preferred embodiment of the emulsions of the present invention, wherein the emulsions comprise Acetyl triethyl citrate as the bleach activator, an adequate nonionic surfactant system would comprise a hydrophobic nonionic surfactant with for instance an HLB of 6, such as a Dobanol $^R$ 23-2 and a hydrophilic nonionic surfactant with for instance an HLB of 15, such as a Dobanol $^R$ 91-10. Other suitable nonionic surfactant systems comprise for example a Dobanol $^R$ 23-6.5 (HLB about 12) and a Dobanol $^R$ 23 (HLB below 6) or a Dobanol $^R$ 45-7 (HLB=11.6) and Lutensol $^R$ TO3 (HLB=8).

In the embodiment of the present invention where the peroxygen bleach-containing compositions of the present invention comprise said bleach activator and are formulated as microemulsions, said peroxygen bleach-containing microemulsions according to the present invention comprise a hydrophilic surfactant system comprising an anionic surfactant and a nonionic surfactant. A key factor in order to stably incorporate the hydrophobic activator is that at least one of said surfactants must have a different HLB value to that of the hydrophobic activator. Indeed, if all said surfactants had the same HLB value as that of the hydrophobic activator, a continuous single phase might be formed thus lowering the chemical stability of the bleach/bleach activator system. Preferably, at least one of said surfactants has an HLB value which differs by at least 1.0 HLB unit, preferably 2.0 to that of said bleach activator.

Suitable anionic surfactants herein include water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Other suitable anionic surfactants for use herein are water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$alkyl polyethoxylate (1.0) sulfate, $C_{12}$–$C_{18}$E(1.0)M), $C_{12}$–$C_{18}$ alkyl polyethoxylate (2.25) sulfate, $C_{12}$–$C_{18}$E(2.25)M), $C_{12}$–$C_{18}$alkyl polyethoxylate (3.0) sulfate $C_{12}$–$C_{18}$E(3.0), and $C_{12}$–$C_{18}$ alkyl polyethoxylate (4.0) sulfate $C_{12}$–$C_{18}$E(4.0)M), wherein M is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Suitable nonionic surfactants for use in the microemulsions herein include the hydrophilic nonionic surfactants as defined herein before.

The preferred making of the microemulsions of the present invention which comprises a liquid hydrophobic bleach activator includes premixing the surfactants with water and subsequently adding the other ingredients including hydrogen peroxide and said hydrophobic bleach activator. Irrespective of this preferred order of addition, it is important that during the mixing of the ingredients, the microemulsions be constantly kept under stirring under relatively high stirring energies, preferably 30 minutes at 750 rpm, most preferably 30 minutes at 1000 rpm.

In the embodiment of the present invention where the compositions are formulated as microemulsions said compositions are macroscopically transparent in the absence of opacifiers and dyes. In centrifugation examination, it was observed that said microemulsions herein showed no phase separation after 15 minutes at 6000 RPM. Under microscopic examination, said microemulsions appeared as a dispersion of droplets in a matrix. The matrix is the hydrophilic matrix described hereinbefore, and the droplets are constituted by the liquid hydrophobic bleach activator. We have observed that the particles had a size which is typically around or below 3 micron diameter.

The compositions suitable to be used according to the present invention may further comprise a foam suppressor such as 2-alkyl alkanol, or mixtures thereof, as a highly preferred optional ingredient. Particularly suitable to be used in the present invention are the 2-alkyl alkanols having an alkyl chain comprising from 6 to 16 carbon atoms, preferably from 8 to 12 and a terminal hydroxy group, said alkyl chain being substituted in the α position by an alkyl chain comprising from 1 to 10 carbon atoms, preferably from 2 to 8 and more preferably 3 to 6. Such suitable compounds are commercially available, for instance, in the Isofol® series such as Isofol® 12 (2-butyl octanol) or Isofol® 16 (2-hexyl decanol). Typically, the compositions suitable to be used herein comprise from 0.05% to 2% by weight of the total composition of a 2-alkyl alkanol, or mixtures thereof, preferably from 0.1% to 1.5% and most preferably from 0.1% to 0.8%.

Although preferred application of the compositions described herein is laundry pretreatment, the compositions according to the present invention may also be used as a laundry detergent or as a laundry detergent booster as well as a household cleaner in the bathroom or in the kitchen. When used as hard surface cleaners, such compositions are easy to rinse and provide good shine characteristics on the cleaned surfaces.

The present invention will be further illustrated by the following examples.

A) Experimental Data

The following compositions were made by mixing the listed ingredients in the listed proportions (weight % unless otherwise specified).

| Compositions | I | II | III | IV | V | VI |
|---|---|---|---|---|---|---|
| Alkylsulphate | 1.2 | 1.2 | 1.2 | 1.2 | 1.2 | 1.2 |
| Dobanol ® 91-10 | 1.6 | 1.6 | 1.6 | 1.6 | 1.6 | 1.6 |
| Dobanol ® 23.3 | 1.1 | 1.1 | 1.1 | 1.1 | 1.1 | 1.1 |
| $H_2O_2$ | 7.0 | 7.0 | 7.0 | 7.0 | 7.0 | 7.0 |
| BHT | 0.03 | 0.03 | 0.03 | 0.03 | 0.03 | 0.03 |
| Perfume | 0.1 | 0.1 | 0.1 | 0.1 | 0.1 | 0.1 |
| S,S-EDDS | — | 0.5 | — | — | — | — |
| DTPMP | — | — | 0.5 | — | — | — |
| MGDA | — | — | — | 0.5 | — | — |
| DTPA | — | — | — | — | 0.5 | — |
| HEDP | — | — | — | — | — | 0.5 |
| Water and minors H2SO4 up to pH 4 | | | up to 100% | | | |
| Tensile strength loss (%) | 60 | 0 | 0 | 2 | 4 | 0 |

50 ppm Copper per gram of fabric

Pretreatment 24 hours

S,S EDDS is ethylenediamine-N,N'-disuccinic acid (S,S isomer).

DTPMP is diethylene triamine penta methylene phosphonate marketed by Monsanto under the trade name DEQUEST®.

MGDA is methyl glycine di-acetic acid.

PDTA is propylene diamine tetracetic acid marketed by BASF under the trade name Trilon FS®.

Composition I comprises only hydrogen peroxide and is free of compounds chelating copper and/or iron and/or manganese. Compositions II to VI are representative of the present invention, they comprise hydrogen peroxide and a compound chelating copper and/or iron and/or manganese. The following test was carried out:

A tensile strength test method was carried out with the compositions mentioned herein above. This test method was carried out on metal-polluted fabrics.

Cotton ribbons (dimension 12.5×5 $cm^2$) having a copper concentration of 50 ppm per gram of cotton were pretreated according to the present invention. Indeed, the cotton ribbons were pretreated with 2 ml of each of the liquid compositions mentioned herein before. The compositions were left in contact with the ribbons for 24 hours, before being rinsed with water. After that, the damage on the fabrics, i.e. cotton ribbons, was evaluated by stretching said ribbons until they broke. The force necessary to break the ribbons, i.e. the Ultimate Tensile Stress, was measured, in wet conditions, with "The Stress-Strain INSTRON Machine". The lower the force needed to break said cotton ribbons, the more serious the damage caused on the fabrics. A good confidence (standard deviation=2÷5 Kg) on the results is obtained using five replicates for each test.

The tensile strength loss mentioned above for the different compositions tested is expressed in percentage and is obtained by comparing the tensile strength of a given fabric taken as a reference, i.e. a fabric which has not been pretreated, to the tensile strength of the same fabric measured after said fabric has been pretreated as mentioned herein before.

The above results clearly show the unexpected safety improvement, i.e. reduction of tensile strength loss, obtained by using liquid compositions according to the present invention comprising a peroxygen bleach and a compound chelating copper and/or iron and/or manganese, as compared to the use of the same compositions but without any compound chelating copper and/or iron and/or manganese (composition I). Indeed, there is virtually no tensile strength loss observed when pretreating fabrics with compositions according to the present invention (see compositions II to VI), this even upon a long contact period, i.e. 24 hours and in presence of a high concentration of copper on the surface of said fabrics, i.e. 50 ppm per gram of cotton fabric.

B) Examples

Following compositions were made by mixing the listed ingredients in the listed proportions (weight % unless otherwise specified).

| Compositions | I | II | III | IV | V | VI | VII | VIII |
|---|---|---|---|---|---|---|---|---|
| $H_2O_2$ | 7.0 | 7.0 | 7.0 | 7.0 | 7.0 | 7.0 | 7.0 | 7.0 |
| Alkylsulphate (1) | 1.2 | 1.2 | 1.2 | 1.2 | 1.2 | 1.2 | 1.2 | 1.2 |
| Dobanol $R_{91-10}$ | 1.6 | 1.6 | 1.6 | 1.6 | 1.6 | 1.6 | 1.6 | 1.6 |
| Dobanol $R_{23-3}$ | 1.1 | 1.1 | 1.1 | 1.1 | 1.1 | 1.1 | 1.1 | 1.1 |
| BHT | 0.03 | 0.03 | 0.03 | 0.03 | — | — | 0.09 | 0.09 |
| 2-Butyl Octanol | 0.5 | 0.5 | 0.5 | 0.5 | 0.5 | 0.5 | 0.5 | 0.5 |
| S,S EDDS | 0.5 | — | — | — | — | — | — | |
| PDTA | — | 0.5 | — | — | — | — | — | — |
| DTPMP | — | — | 0.5 | — | 0.18 | — | — | — |
| MGDA | — | — | — | 0.5 | — | — | — | — |
| HPNO | — | — | — | — | — | 0.1 | — | — |
| HEDP | — | — | — | — | — | — | 0.18 | — |
| DTPA | — | — | — | — | — | — | — | 0.1 |
| Water and minors (dye) $H_2SO_4$ up to pH 4 | | | | up to 100% | | | | |

S,S EDDS is ethylenediamine-N,N'-disuccinic acid (S,S isomer).

DTPMP is diethylene triamine penta methylene phosphonate marketed by Monsanto under the trade name DEQUEST®.

MGDA is methyl glycine di-acetic acid.

PDTA is propylene diamine tetracetic acid marketed by BASF under the trade name Trilon FS®.

HPNO is 2-hydroxy pyridine-N-oxide.

HEDP is hydroxy-ethane diphosphonic acid.

DTPA is diethylene triamine penta acetic acid.

| Compositions | IX | X | XI | XII | XIII |
|---|---|---|---|---|---|
| $H_2O_2$ | 7.0 | 7.0 | 7.0 | 4.0 | 6.0 |
| Alkylsulphate (1) | 1.2 | 1.2 | 1.2 | 2.0 | — |
| AES 25-3 | — | — | — | — | 12.0 |
| Dobanol $R_{45-7}$ | — | — | — | 6.4 | 6.0 |
| Dobanol $R_{91-10}$ | 1.6 | 1.6 | 1.6 | — | — |
| Dobanol $R_{23-3}$ | 1.1 | 1.1 | 1.1 | 8.6 | — |
| Dobanol $R_{23-6.5}$ | — | — | — | — | 6.0 |
| Activator (ATC) | — | — | — | 3.5 | 3.5 |
| BHT | 0.03 | 0.03 | 0.03 | 0.05 | 0.05 |
| S,S EDDS | 0.1 | — | — | — | — |
| PDTA | — | 0.1 | — | — | — |
| DTPMP | — | — | 0.1 | — | — |
| HEDP | — | — | — | 0.1 | 0.1 |
| Dipicolinic acid | 0.05 | 0.05 | 0.05 | — | — |
| Water and minors | | | up to 100% | | |

The compositions in examples I to XIII are according to the present invention. A pretreatment process was carried out according to the present invention with compositions I to XIII with virtually no tensile strength loss of the fabrics treated, even when leaving the compositions to act onto said fabrics for 24 hours before washing said fabrics.

We claim:

1. A process of pretreating soiled fabrics with a liquid composition comprising a peroxygen bleach, butyl hydroxy toluene a nonionic surfactant system, an anionic surfactant comprising an alkyl sulphate and/or an alkyl ethoxylated sulphate, and a compound chelating copper and/or iron and/or manganese, selected from the group consisting of ethylene diamine N,N'-disuccinic acid or alkali metal, or alkaline earth or ammonium or substituted ammonium salts thereof, diethylene triamine penta acetic acid, methyl glycine di-acetic acid, diethylene triamine penta methylene phosphonic acid, hydroxy-ethane diphosphonic acid, propylene diamine tetraacetic acid, 2-hydroxypyridine-N-oxide, ethylene dinitrilotertrakis (methylene phosphonic acid) N,N-oxide and mixtures thereof wherein said nionic surfactant system includes one or more nonionic surfatants selected from the group consisting of hydrophobic nonionic surfactants having an HLB up to 9 and having the formula: $RO—(C_2H_4O)_n(C_3H_6O)_mH$, wherein R is a $C_6$ to $C_{22}$ alkyl chain or a $C_6$ to $C_{28}$ alkyl benzene chain and mixtures thereof, and wherein n+m is from 0.5 to 5 and n is from 0 to 5 and m is from 0 to 5; said process comprising the steps of applying said composition in its neat form onto the fabric and allowing said composition to remain in contact with said fabric without leaving said composition to dry onto said fabric, before said fabric is washed.

2. A process according to claim 1 wherein said liquid composition comprises from about 0.005% to about 2% by weight of the total composition of said compound chelating copper and/or iron and/or manganese, or mixtures thereof.

3. A process according to claim 1 wherein said peroxygen bleach is hydrogen peroxide or a water soluble source thereof.

4. A process according to claim 1 wherein said composition comprises from about 0.5% to about 20% by weight of the total composition of said peroxygen bleach or mixtures thereof.

5. A process according to claim 1 wherein said composition further comprises a surfactant up to a level of about 50% by weight of the total composition.

6. A process according to claim 3 wherein said peroxygen bleach is hydrogen peroxide.

7. A process according to claim 1 wherein said nonionic surfactant and anionic surfactant are present in said composition up to a level of 50% by weight of the total composition.

8. The process according to claim 2 wherein said hydrophobic nonionic surfactants are selected from the group consisting of hydrophobic nonionic surfactants having the formula: $RO—(C_2H_4O)_n(C_3H_6O)_mH$ wherein R is a $C_8$ to $C_{22}$ alkyl chain.

9. The process according to claim 8 wherein said hydrophobic nonionic surfactants are selected from the group consisting of:

a) hydrophobic nonionic surfactants having an HLB of 8.1 and having the formula: $RO—(C_2H_4O)_n(C_3H_6O)_mH$ wherein R is a mixture of $C_9$ to $C_{11}$ alkyl chains, n is 2.5 and m is 0;

b) hydrophobic nonionic surfactants having an HLB of 8 and having the formula: $RO—(C_2H_4O)_n(C_3H_6O)_mH$ wherein R is a mixture of $C_{13}$ to $C_{15}$ alkyl chains, n is 3 and m is 0;

c) hydrophobic nonionic surfactants having an HLB of 7.7 and having the formula: $RO—(C_2H_4O)_n(C_3H_6O)_mH$ wherein R is a $C_{12}$ to $C_{15}$ alkyl chain, n is 3 and m is 0;

d) hydrophobic nonionic surfactants having an HLB of 8.1 and having the formula: $RO—(C_2H_4O)_n(C_3H_6O)_mH$ wherein R is a mixture of $C_{12}$ to $C_{13}$ alkyl chains, n is 3 and m is 0;

e) hydrophobic nonionic surfactants having an HLB of 6.2 and having the formula: $RO—(C_2H_4O)_n(C_3H_6O)_mH$ wherein R is a mixture of $C_{12}$ to $C_{13}$ alkyl chains, n is 2 and m is 0; and f) mixtures thereof.

10. A liquid detergent composition comprising a peroxygen bleach, butyl hydroxy toluene a nonionic surfactant system, an anionic surfactant comprising an alkyl sulphate or an alkyl ethoxylated sulphate, and a compound chelating copper and/or iron and/or manganese selected from the group consisting of ethylene diamine N,N'disuccinic acid or alkali metal or alkaline earth, ammonium or ammonium substituted salts thereof, diethylene triamine penta acetic acid, methyl glycine di-acetic acid, diethylene triamine penta methylene phosphonic acid, hydroxy-ethane diphsophonic acid, propylene diamine tetraacetic acid, 2-hydroxypyridine-N-oxide, ethylene dinitrilotertrakis (methylene phosphonic acid) N,N-oxide and mixtures thereof, wherein said nonionic surfactant system includes one or more noniomc surfactants selected from the group consisting of hydrophobic nonionic surfactants having an HLB up to 9 and having the formula: $RO—(C_2H_4O)_n(C_3H_6O)_mH$, wherein R is a $C_6$ to $C_{22}$ alkyl chain or a $C_6$ to $C_{28}$ alkyl benzene chain and mixtures thereof, and wherein n+m is from 0.5 to 5 and n is from 0 to 5 and m is from 0 to 5.

11. A composition according to claim 10 wherein said peroxygen bleach is a hydrogen peroxide or a water soluble source thereof, and wherein said composition comprises from about 0.5% to about 20% by weight of the total composition of said peroxygen bleach.

12. A composition according to claim 11 wherein said composition comprises from about 2% to about 15% by weight of the total composition of said peroxygen bleach.

13. A composition according to claim 10 wherein said liquid composition comprises from about 0.005% to about 2% by weight of the total composition of said compound chelating copper and/or iron and/or manganese or mixtures thereof.

14. A composition according to claim 13 wherein said liquid composition comprises from about 0.01% to about 1% by weight of the total composition of said compound chelating copper and/or iron and/or manganese or mixtures thereof.

15. A composition according to claim 10 wherein said composition is aqueous and has a pH of from about 1 to about 9.

16. A composition according to claim 15 wherein said composition has a pH of from about 2 to about 6.

17. A composition according to claim 10 wherein said compound chelating copper and/or iron and/or manganese is selected from the group consisting of methyl glycine diacetic acid, hydroxy-ethane diphosphonic acid, propylene diamine tetracetic acid, 2-hydroxypyridine-N-oxide, ethylenedinitrilotertrakis (methylene-phosphonic acid) N,N'-oxide and mixtures thereof.

18. A composition according to claim 11 wherein said peroxygen bleach is hydrogen peroxide.

19. A composition according to claim 1 wherein said nonionic surfactant and anionic surfactant are present in said composition up to a level of 50% by weight of the total composition.

20. The composition according to claim 10 wherein said hydrophobic nonionic surfactants are selected from the group consisting of hydrophobic nonionic surfactants having the formula: $RO—(C_2H_4O)_n(C_3H_6O)_mH$ wherein R is a $C_8$ to $C_{22}$ alkyl chain.

21. The composition according to claim 20 wherein said hydrophobic nonionic surfactants are selected from the group consisting of:

a) hydrophobic nonionic surfactants having an HLB of 8.1 and having the formula: $RO—(C_2H_4O)_n(C_3H_6O)_m H$ wherein R is a mixture of $C_9$ to $C_{11}$ alkyl chains, n is 2.5 and m is 0;

b) hydrophobic nonionic surfactants having an HLB of 8 and having the formula: $RO—(C_2H_4O)_n(C_3H_6O)_m H$ wherein R is a mixture of $C_{13}$ to $C_{15}$ alkyl chains, n is 3 and m is 0;

c) hydrophobic nonionic surfactants having an HLB of 7.7 and having the formula: $RO—(C_2H_4O)_n(C_3H_6O)_m H$ wherein R is a $C_{12}$ to $C_{15}$ alkyl chain, n is 3 and m is 0;

d) hydrophobic nonionic surfactants having an HLB of 8.1 and having the formula: $RO—(C_2H_4O)_n(C_3H_6O)_m H$ wherein R is a mixture of $C_{12}$ to $C_{13}$ alkyl chains, n is 3 and m is 0;

e) hydrophobic nonionic surfactants having an HLB of 6.2 and having the formula: $RO—(C_2H_4O)_n(C_3H_6O)_m H$ wherein R is a mixture of $C_{12}$ to $C_{13}$ alkyl chains, n is 2 and m is 0; and f) mixtures thereof.

* * * * *